United States Patent [19]

Wenstadt

[11] Patent Number: 4,605,377

[45] Date of Patent: Aug. 12, 1986

[54] MANUAL LIFT MEANS FOR MARINE PROPULSION DEVICE

[75] Inventor: Thomas D. Wenstadt, Winthrop Harbor, Ill.

[73] Assignee: Outboard Marine Corporation, Waukegan, Ill.

[21] Appl. No.: 622,885

[22] Filed: Jun. 21, 1984

[51] Int. Cl.[4] ..... B63H 5/12

[52] U.S. Cl. ..... 440/61; 440/53

[58] Field of Search ..... 440/53–65; 248/640–642; 188/318, 316, 313, 317, 319, 299; 267/127

[56] References Cited

U.S. PATENT DOCUMENTS

| | | | |
|---|---|---|---|
| Re. 27,932 | 2/1974 | Mettetal, Jr. | 440/61 |
| 1,527,592 | 2/1925 | Livezey | 188/299 |
| 2,953,335 | 9/1960 | Kiekhaefer | 248/567 |
| 3,186,375 | 1/1965 | Cass | 440/61 |
| 3,246,915 | 4/1966 | Alexander, Jr. | 248/567 |
| 3,285,221 | 11/1966 | North | 440/61 |
| 3,434,448 | 3/1969 | Woodfill | 440/61 |
| 3,434,450 | 3/1969 | McCormick | 440/61 |
| 3,709,104 | 3/1974 | Kurling | 440/61 |
| 3,722,455 | 3/1973 | Carpenter | 440/61 |
| 3,799,104 | 3/1974 | Kurling | 440/61 |
| 3,839,986 | 10/1974 | Meyer et al. | 440/61 |
| 3,863,592 | 2/1975 | Borst | 440/61 |
| 3,885,517 | 5/1975 | Borst et al. | 440/61 |
| 3,888,203 | 6/1975 | Lohse | 440/61 |
| 3,983,835 | 10/1976 | Hall | 440/61 |
| 3,999,502 | 12/1976 | Mayer | 440/61 |
| 4,052,952 | 10/1977 | Hale et al. | 440/61 |
| 4,064,824 | 12/1977 | Hall et al. | 440/61 |
| 4,363,629 | 12/1982 | Hall | 440/61 |
| 4,391,592 | 7/1983 | Hundertmark | 440/53 |
| 4,403,969 | 9/1983 | Pichl | 440/56 |
| 4,449,470 | 5/1984 | Rump | 440/61 |
| 4,493,659 | 1/1985 | Iwashita | 440/61 |
| 4,521,202 | 6/1985 | Nakahama | 440/56 |
| 4,545,769 | 5/1983 | Nakahama et al. | 440/61 |

FOREIGN PATENT DOCUMENTS

| | | | |
|---|---|---|---|
| 1068872 | 11/1959 | Fed. Rep. of Germany | 440/61 |
| 2915012 | 11/1980 | Fed. Rep. of Germany | 440/61 |

*Primary Examiner*—Galen L. Barefoot
*Assistant Examiner*—C. T. Bartz
*Attorney, Agent, or Firm*—Michael, Best & Friedrich

[57] ABSTRACT

A marine propulsion device comprising a support bracket attached to a boat hull, a propulsion unit, a tilt pin connecting the propulsion unit and support bracket for tilting movement of the propulsion unit, and an extendable and retractable cylinder-piston assembly for facilitating manual tilting movement of the propulsion unit. The cylinder-piston assembly comprises a cylinder, a piston located in the cylinder for reciprocative movement therein, a piston rod connected to the piston and extendable from the cylinder, and lugs connecting the cylinder-piston assembly to the support bracket and the propulsion unit. The marine propulsion device also includes a predetermined quantity of incompressible fluid partially filling the cylinder, a gas with a pressure higher than atmospheric pressure filling the remainder of the cylinder, and a manually operable mechanism in communication with the first end and the second end of the cylinder for selectively preventing fluid flow between the first end and the second end of the cylinder.

14 Claims, 3 Drawing Figures

MANUAL LIFT MEANS FOR MARINE PROPULSION DEVICE

BACKGROUND OF THE INVENTION

This invention relates to marine propulsion devices such as outboard motors and, more particularly, to devices for facilitating manual tilting movement of a propulsion unit about a horizontal transverse axis, and mechanisms for locking the propulsion unit in place.

Attention is directed to Borst U.S. Pat. No. 3,863,592, issued Feb. 4, 1975, which is hereinafter incorporated by reference. Attention is also directed to Pichl U.S. Pat. No. 4,403,969, issued Sept. 13, 1983.

SUMMARY OF THE INVENTION

This invention provides a marine propulsion device comprising a support bracket adapted to be attached to a boat hull, a propulsion unit, means connecting the propulsion unit and support bracket for tilting movement of the propulsion unit in a vertical plane about a horizontal transverse axis between an operating position and a raised nonoperating position, and extendable and retractable cylinder-piston means for facilitating manual tilting movement of the propulsion unit upwardly about the axis when the support bracket is attached to a boat hull. The cylinder-piston means comprises a cylinder including a first end and a second end, a piston located in the cylinder for reciprocative movement therein, a piston rod connected to the piston and extendable from the second end of the cylinder, and means connecting the cylinder-piston means to the support bracket and the propulsion unit for extending the cylinder-piston means in response to upward tilting movement of the propulsion unit, and for retracting the cylinder-piston means in response to downward tilting movement of the propulsion unit. The connecting means comprises means pivotally connecting the first end of the cylinder to one of the support bracket and the propulsion unit, and means pivotally connecting the piston rod to the other of the support bracket and the propulsion unit. The marine propulsion device also includes a predetermined quantity of incompressible fluid partially filling the cylinder, a gas with a pressure higher than atmospheric pressure filling the remainder of the cylinder, and manually operable valve and conduit means in communication with the first end and the second end of the cylinder for selectively preventing fluid flow between the first end and the second end of the cylinder.

In one embodiment, the marine propulsion device also includes a housing, a movable wall located in the housing and defining a variable volume gas chamber and a variable volume fluid chamber, and means permitting fluid passage between the variable volume fluid chamber and the cylinder. The predetermined quantity of incompressible fluid fills the cylinder and the fluid chamber, and the gas with a pressure higher than atmospheric pressure fills the gas chamber. In this embodiment, the fluid chamber is in communication with the first end of the cylinder.

In one embodiment, the manually operable valve and conduit means comprises conduit means communicating between the first end of the cylinder and the second end of the cylinder, and valve means in the conduit means. The valve means includes a first one-way check valve which is in the conduit means and which permits fluid flow from the first end of the cylinder to the second end of the cylinder and which prohibits fluid flow from the second end of the cylinder to the first end of the cylinder. The valve means also includes a second one-way check valve which is in the conduit means and which permits fluid flow from the second end of the cylinder to the first end of the cylinder and which prohibits fluid flow from the first end of the cylinder to the second end of the cylinder. The valve means also includes means for alternately opening, for flow in one direction through the valve means, one of the first one-way check valve and second one-way check valve, and for fluid flow in an opposite direction through the valve means, the other of the first one-way check valve and the second one-way check valve. The means for alternately opening one of the first and second one-way check valves comprises a spool slideably received in the conduit means and between the first one-way check valve and the second one-way check valve, means permitting fluid flow relative to the spool, and means for moving the spool between a first position adjacent the first one-way check valve and a second position adjacent the second one-way check valve. The means for alternately opening the first and second one-way check valves also includes projection means on the spool for respectively opening the first one-way check valve when the spool is adjacent the first one-way check valve, and for opening the second one-way check valve when the spool is adjacent the second one-way check valve.

One of the principal features of the invention is the provision of a device including a cylinder-piston assembly for facilitating manual tilting movement of a propulsion unit upwardly about a tile axis, and, for locking and releasing the propulsion unit, a mechanism which is self contained and has few moving parts, and which does not include exposed mechanical retaining linkage which can be adversely affected by corrosion.

Another of the principal features of the invention is the provision of such a mechanism which has greater reliability than previous mechanisms.

Other features and advantages of of the invention will become apparent upon reviewing the drawings, the description, and the appended claims.

Figure 2:
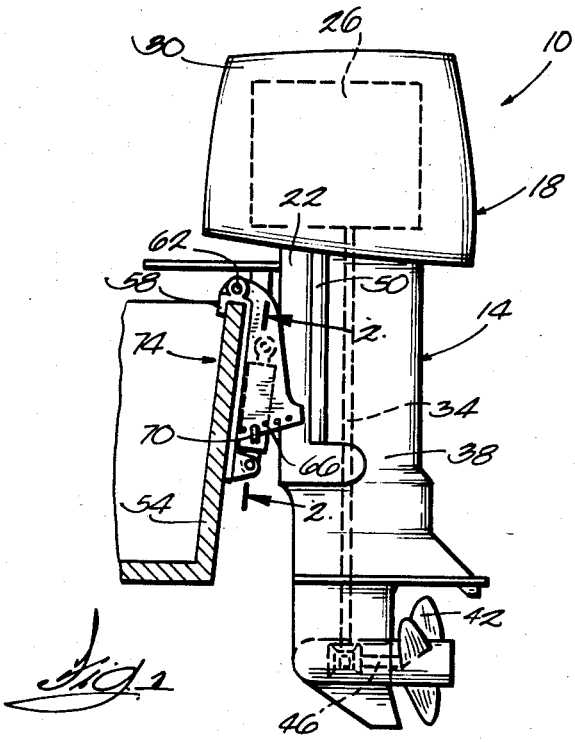
FIG. 2 is an enlarged cross-sectional view taken along the line 2—2 in FIG. 1.

Before explaining the invention in detail, it is to be understood that the invention is not limited in its application to the details of construction and the arrangement of the components set forth in the following description or illustrated in the drawings. The invention is capable of other embodiments and of being practiced or carried out in various ways. Also, it is to be understood that the phraseology and terminology employed herein is for the purposes of description and should not be regarding as limiting.

DESCRIPTION OF THE PREFERRED EMBODIMENT

Figure 1:
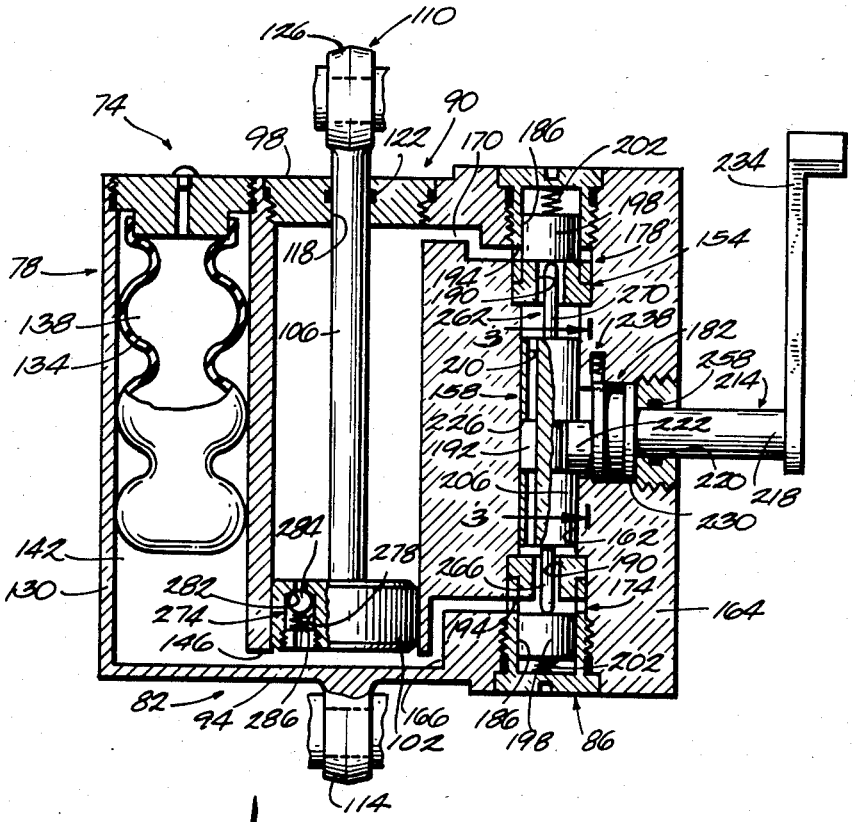
FIG. 1 is a fragmentary elevational view of an outboard motor which embodies various of the features of the invention.

Shown in the drawings is an outboard motor 10 which embodies various of the features of the invention. As illustrated in FIG. 1, the outboard motor 10 comprises a propulsion assembly 14 including a propulsion unit 18 and a swivel bracket 22. The propulsion unit 18 includes an engine 26 enclosed within a cowl 30, a drive shaft 34 which is enclosed inside a drive shaft housing 38 and which drivingly connects the engine 26 and a propeller 42 via a propeller shaft 46. The propulsion unit 18 is connected to the swivel bracket 22 for horizontal swinging movement about a generally vertical king pin 50 for steering control of the propulsion unit 18. The propulsion assembly 14 is fastened to a transom 54 or other supporting member of a boat hull by a support or transom bracket 58. The swivel bracket 22 is connected to the transom bracket 58 for common swinging movement in a vertical plane or tilting of the propulsion unit 18 and the swivel bracket 22 about a transverse horizontal axis provided by a tilt pin 62. The propulsion assembly 14 is movable about the tilt pin 62 between an operating position, and a raised nonoperating position.

The transom bracket 58 includes a series of apertures 66 adapted to selectively receive a trim adjustment or thrust pin 70 which is normally engaged by the swivel bracket 22 for positioning the propulsion unit 18 in a desired operating position with respect to the vertical.

As illustrated in FIGS. 1 and 2, a tilting and locking assembly 74 is connected between the propulsion unit 18 and the transom bracket 58. The tilting and locking assembly 74 includes an accumulator 78, extendable and retractable cylinder-piston means 82 for facilitating manual tilting movement of the propulsion unit 18 upwardly about the horizontal tilt axis, and manually operable valve and conduit means 86 for selectively preventing extension or retraction of the cylinder-piston means 82.

As illustrated in FIG. 2, the cylinder-piston means 82 comprises one or more cylinders 90 including a first end 94 and a second end 98. Although the cylinder 90 shown in FIG. 2 is made up of different connected parts or sections, the cylinder 90 will be referred to as a single structure for purposes of this description.

The cylinder-piston means 82 also includes a piston 102 located with the cylinder 90 for reciprocative movement therein, and a piston rod 106 connected to the piston 102 and extending from the second end 98 of the cylinder 90. The cylinder-piston means 82 also includes means 110 for connecting the cylinder-piston means 82 to the transom bracket 58 and the propulsion unit 18 for extending the cylinder-piston means 82 in response to upward tilting movement of the propulsion unit 18, and for retracting the cylinder-piston means 82 in response to downward tilting movement of the propulsion unit 18.

More particularly, the connecting means 110 includes a mounting lug 114 projecting from the first end 94 of the cylinder 90 for pivotally connecting the first end 94 of the cylinder-piston means 82 to one of the transom bracket 58 and the propulsion unit 18. Still more particularly, in this embodiment, the mounting lug 114 is connected to the transom bracket 58.

Attached to the outer end of the piston rod 106 for pivotally connecting the piston rod 106 to the other of the transom bracket 58 and the propulsion unit 18 is another mounting lug 126. More particularly, in this embodiment, the mounting lug 126 is connected to the swivel bracket 22 in such manner that the cylinder 90 is generally vertical and the moment arm between the center of the mounting lug 126 and the pivot axis of the tilt pin 62 remains essentially constant as the propulsion unit 18 is moved through the tilt arc.

The second or upper end 98 of the cylinder 90 includes an opening 118 through which the piston rod 106 slidably extends. Suitable packing or sealing means 122 is provided at the opening 118 and surrounds the piston rod 106 to insure a fluid-tight seal between the piston rod 106 and the upper end 98 of the cylinder 90.

Although other constructions can be employed in other embodiments, the accumulator 78 is integrally connected to the cylinder 90. The accummulator 78 comprises a housing 130 defining a recess, and a movable wall 134 which is located in the housing 130 and which divides the recess into a variable volume gas chamber 138 and a variable volume fluid chamber 142. The accumulator 78 also includes means 146 permitting fluid passage between the variable volume fluid chamber 142 and the interior of the cylinder 90.

Although the housing 130 shown in FIG. 2 is made up of different connected parts or sections, the housing 130 will be referred to as a single structure for purposes of this description.

More particularly, in this embodiment, the movable wall 134 is in the form of a flexible bladder which is attached at the perimeter thereof to one end of the housing 130. The means 146 for permitting fluid passage between the variable volume fluid chamber 142 and the cylinder 90 is in the form of a passageway extending between the fluid chamber 142 and the first end 94 of the cylinder 90. In other embodiments (not shown), the fluid passageway 146 can communicate with the second end 98 of the cyliner 90. In other embodiments (not shown), the accummulator 78 can also be located remotely from the cylinder 90 and connected via a conduit to one end of the cylinder 90, or the accumulator housing 130 can be an extension (not shown) of the cylinder 90.

Filling the cylinder 90 and the variable volume fluid chamber 142 is a predetermined quantity of incompressible liquid such as oil or hydraulic fluid. The incompressible liquid is pressurized by a gas which has a pressure higher than atmospheric pressure and which fills the variable volume gas chamber 138. The movable wall 134 separates the gas from the hydraulic fluid and thereby prevents dispersion of the gas in the incompressible liquid.

When the ends of the cylinder 90 are in communication, the pressure acting on the opposite sides of the piston 102 is essentially equal. Because the effective surface area of the piston 102 on which this pressure acts is less on the piston rod side of the piston 102 than on the other side of the piston 102, there is a net force on the piston 102 which serves to extend the cylinder-piston means 82.

Because the piston rod 106 occupies volume inside the cylinder 90, as the piston rod 106 extends, the available volume within the cylinder 90 increases, thus expanding the gas chamber 138 in the accummulator 78. This, accordingly, decreases the effective pressure of the pressurized fluid. This results in a reduction in the pressure differential across the piston 102 which decreases the lifting force of the cylinder-piston means 82. This reduction in net force corresponds to a reduction in the force required to lift the propulsion assembly 14, as described in more detail in Borst U.S. Pat. No. 3,863,592, issued Feb. 4, 1975, which is incorporated herein by reference.

In accordance with one embodiment of the invention, the areas of the piston 102 and the piston rod 106, the volume of the liquid, and the pressure and volume of the gas are balanced so that the net force acting on the piston 102 to extend the piston rod 106 is matched with the force required to approximately counterbalance the weight of the propulsion assembly. In other embodiments, the net force acting on the piston 102 to extend the piston rod 106 can be slightly lesser or slightly greater than the force required to counterbalance the weight of the propulsion assembly 14. Accordingly, depending upon the net force chosen to act on the piston 102 to extend the piston rod 106, the propulsion assembly 14 may be either automatically lifted to the raised position by the tilting and locking assembly 74, or lowered by the weight of the propulsion assembly 14 to the operating position, or may require reduced manually applied force to move the propulsion assembly 14 in either direction.

The manually operable valve and conduit means 86 includes conduit means 154 communicating between the first end 94 of the cylinder 90 and the second end 98 of the cylinder 90, and valve means 158 in the conduit means 154. Still more particularly, although other constructions can be employed in other embodiments, the manual operable means 86 is operable in a first or running mode to prevent fluid flow from the second end 98 of the cylinder 90 to the first end 94 of the cylinder 90, and to permit fluid flow from the first end 94 of the cylinder 90 to the second end 98 of the cylinder 90, and is operable in a second or raising mode to prevent fluid flow from the first end 94 of the cylinder 90 to the second end 98 of the cylinder 90, and to permit fluid flow from the second end 98 of the cylinder 90 to the first end 94 of the cylinder 90.

While other constructions can be employed in other embodiments, the conduit means 154 comprises a conduit 162 extending through a housing 164 integrally connected to the cylinder 90. The conduit 162 is in communication with the first end 94 of the cylinder 90 and the second end 98 of the cylinder 90 by means of passageways 166 and 170, respectively.

In other embodiments (not shown), the housing 164 can be remotely located from the cylinder 90. Although the housing 164 shown in FIG. 2 is made up of different connecting parts or sections, the housing 164 will be referred to as a single structure for purposes of this description.

The valve means 158 includes a first normally closed one-way check valve 174 which is in the conduit 162 and which permits fluid flow from the first end 94 of the cylinder 90 to the second end 98 of the cylinder 90 and which prohibits fluid flow from the second end 98 of the cylinder 90 to the first end 94 of the cylinder 90. The valve means 158 also includes a second normally closed one-way check valve 178 which is in the conduit 162 and which permits fluid flow from the second end 98 of the cylinder 90 to the first end 94 of the cylinder 90 and which prohibits fluid flow from the first end 94 of the cylinder 90 to the second end 98 of the cylinder 90. The valve means 158 also includes manually operable means 182 for alternately opening for fluid flow in one direction through the valve means 158, one of the first one-way chack valve 174 and the second one-way check valve 178, and for fluid flow in an opposite direction through the valve means 158, the other of the first one-way check valve 174 and the second one-way check valve 178.

The first and second one-way check valves 174 and 178, respectively, are generally identically constructed and each comprises a recess 186 in the housing 164 including an opening 190 to a conduit portion 192 between the one-way check valves 174 and 178, and an opening 194 to the respective passageway to the adjacent end of the cylinder 90. Located within the recess 186 between the two openings 190 and 194 is a movable blocking member 198 which is biased by a spring 202 to close the openings 190 and 194. The bias of the spring 202 is selected so as to permit fluid flow from the conduit portion 192 through the opening 190, but to prohibit fluid flow from the adjacent end of the cylinder 90 through the opening 194.

The manually operable means 182 for alternately opening one of the first one-way check valve 174 and the second one-way check valve 178 comprises a spool 206 slideably received in the conduit portion 102 between the first one-way check valve 174 and the second one-way check valve 178. The manually operable means 182 also includes means for affording fluid flow relative to the spool in the form of a passageway 210 through the spool 206, and manually operable means 214 for moving the spool 206 between a first or running position adjacent the first one-way check valve 174, and a second or raising position adjacent the second one-way check valve 178.

Figure 3:
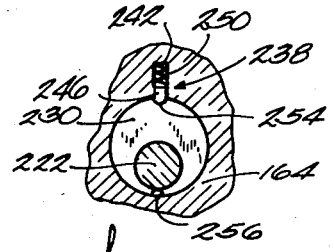
FIG. 3 is a partial cross-sectional view taken along the line 3—3 in FIG. 2.

The means 214 for moving the spool 206 comprises a shaft 218 received in a bore 220 in the housing 164 and including an eccentric portion 222 which is received in an annular groove 226 in the spool 206, and which moves the spool 206 in one direction or the other when the shaft 218 is rotated. As illustrated in FIGS. 2 and 3, the eccentric portion 222 is on a disc 230 on the end of the shaft 218, and the shaft 218 is rotatable by a lever 234. The lever 234 is outside of the housing 164 and accessible in the outboard operator.

As illustrated in FIG. 3, the means 214 for moving the spool 206 also includes detent means 238 for holding the shaft 218 and thereby the spool 206 in either the running position or the raising position, so that either the first one-way check valve 174 or the second one-way check valve 178 is open. More particularly, the detent means 238 comprises a recess 242 adjacent the disc portion 230 of shaft 218, and a rounded member 246 which is located in the recess 242 and which is biased by a spring 250 towards the shaft 218. The detent means also includes, on the disc portion 230 of the shaft 218, a first recess 154 and a second recess 256. The first recess 254 and second recess 256, respectively, partially and yieldably receives the rounded member 246 when the shaft 218 and spool 206 are in the first or running position and the second or raising position, respectively.

As illustrated in FIG. 2, suitable seal means 258 is provided around the shaft 218 to prevent the passage of fluid around the shaft 218 from the conduit 162 to outside of the housing 164.

The means 182 for alternately opening one of the first one-way check valve 174 and the second check valve 18 also includes projection means 262 on the ends of the spool 206 for respectively opening the first one-way check valve 174 when the spool 206 is adjacent the first one-way check valve 174, and for opening the second one-way check valve 178 when the spool 206 is adjacent the second one-way check valve 178.

More particularly, the projection means 262 comprises a first projection 266 which is on one end of the spool 206 and which extends into the opening 190 of the first one-way check valve 174 when the spool 206 is in the first position, and a second projection 270 which is on the other end of the spool 206 and which extends into the opening 190 of the second one-way check valve 178 when the spool 206 is in the second position. Each of the projections 266 and 270 on the spool 206 has a diameter smaller than the diameter of the opening 190 into the recess 186. Each of the projections 266 and 270 can thus open the respective one-way check valve by moving the blocking member 198 to thereby permit fluid to flow from the cylinder 90 around the respective projection and through the spool 206 and conduit portion 192.

In an alternate embodiment (not shown), some of the features of the invention can be obtained by valve means 158 comprising a manually operable valve which alternatively permits communication between the two ends of the cylinder 90 or prohibits communication between the two ends of the cylinder 90. The valve means 158 in this embodiment would have to be opened and then closed to unlock, move and then relock the propulsion assembly 14, but the propulsion assembly 14 would be hydraulically locked in any selected tilt position and the thrust pin 70 could be eliminated.

In the embodiment illustrated in the drawings, the tilting and locking assembly 74 operates in the following manner. When the lever 234 moves the spool 206 into the raising position, wherein the second one-way check valve 178 is open to fluid flow, fluid is free to flow from the second end 98 of the cylinder 90 to the first end 94 of the cylinder 90. This permits extension of the cylinder-piston means 82 so that the propulsion assembly 14 can be raised from the operating position to the nonoperating position. After the propulsion assembly 14 reaches the raised nonoperating position, lowering of the propulsion assembly 14 is prevented until the lever 234 is moved to the running position.

When the lever 234 moves the spool 206 into the running position, as illustrated in FIG. 2, wherein the first one-way check valve 174 is open to fluid flow, fluid is free to flow from the first end 94 of the cylinder 90 to the second end 98 of the cylinder 90. This permits retraction of the cylinder-piston means 82 so that the propulsion assembly 14 can be lowered from the nonoperating position to the operating position adjacent the thrust pin 70. After the propulsion assembly 14 reaches the operating position, raising of the propulsion assembly 14 under normal operating conditions is prevented until the lever 234 is moved to the raising position.

In order to accommodate high shock loads on the propulsion assembly 14 when the propulsion asssembly 14 in the operating position strikes an underwater obstacle, means 274 is provided to selectively permit a by-pass flow of liquid from the second end 98 of the cylinder 90 to the first end 94 of the cylinder 90 so that the propulsion assembly 14 can tilt rapidly and clear the underwater obstacle. While various arrangements can be used, in the construction illustrated, such means 274 is in the form of a relief valve including a by-pass valve orifice 278 which extends axially through the piston 102, a shoulder 282 within the by-pass orifice 278 forming a seat for a ball valve 284, and a relief spring 286 urging the ball valve 284 against the shoulder 282. The relief valve 274 opens to permit liquid to flow from the second end 98 of the cylinder 90 to the first end 94 of the cylinder 90 when the differential pressure across the piston 102 exceeds a predetermined level corresponding to an abnormal high shock load. After the cylinder-piston means 82 extends when striking an underwater obstacle, the propulsion assembly 14 can be lowered to the operating position without moving the lever 234 since the spool 206 is in the first or operating position.

At least some of the advantages of the invention can also be obtained if the manual tilting assembly 74 does not include the movable wall 134. If the movable wall 134 is not present, gas can disperse in the incompressible liquid. If gas is present in the incompressible liquid at both ends of the cylinder 90, the piston 102 is capable of some axial movement in the cylinder 90, even though the ends of the cylinder 90 are not in communication.

Various of the features of the invention are set forth in the following claims.

I claim:

1. A marine propulsion device comprising a support bracket adapted to be attached to a boat hull, a propulsion unit, means connecting said propulsion unit and said support bracket for tilting movement of said propulsion unit in a vertical plane about a horizontal transverse axis between an operating position and a raised nonoperating position, extendable and retractable cylinder-piston means for facilitating manual tilting movement of said propulsion unit upwardly about said axis when said support bracket is attached to a boat hull, said cylinder-piston means comprising a cylinder including a first end and a second end, a piston located in said cylinder for reciprocative movement therein, a piston rod connected to said piston and extending from said second end of said cylinder, means connecting said cylinder-piston means to said support bracket and said propulsion unit for extending said cylinder-piston means in response to upward tilting movement of said propulsion unit, and for retracting said cylinder-piston means in response to downward tilting movement of said propulsion unit, said connecting means comprising means pivotally connecting said first end of said cylinder to one of said support bracket and said propulsion unit, and means pivotally connecting said piston rod to the other of said support bracket and said propulsion unit, a predetermined quantity of incompressible fluid partially filling said cylinder, a gas with a pressure higher than atmospheric pressure filling the remainder of said cylinder, a single conduit communicating solely with said first end and said second end of said cylinder, and manually operable valve means in said conduit for selectively preventing fluid flow between said first end and said second end of said cylinder.

2. A marine propulsion device comprising a support bracket adapted to be attached to a boat hull, a propulsion unit, means connecting said propulsion unit and said support bracket for tilting movement of said propulsion unit in a vertical plane about a horizontal transverse axis between an operating position and a raised nonoperating position, extendable and retractable cylinder-piston means for facilitating manual tilting movement of said propulsion unit upwardly about said axis when said support bracket is attached to a boat hull, said cylinder-piston means comprising a cylinder including a first end and a second end, a piston located in said cylinder for reciprocative movement therein, a piston rod connected to said piston and extending from said second end of said cylinder, means connecting said cylinder-piston means to said support bracket and said propulsion unit for extending said cylinder-piston means in response to upward tilting movement of said propulsion unit, and for retracting said cylinder-piston means in response to downward tilting movement of said propulsion unit, said connecting means comprising means pivotally connecting said first end of said cylinder to one of said support bracket and said propulsion unit, and means pivotally connecting said piston rod to the other of said support bracket and said propulsion unit, a housing, a movable wall located in said housing and defining a variable volume gas chamber and a variable volume fluid chamber communicating with said cylinder, a predetermined quantity of incompressible fluid filling said cylinder and said fluid chamber, a gas with a pressure higher than atmospheric pressure filling said gas chamber, a single conduit communicating solely with said first and second ends of said cylinder, and manually operable valve means in said conduit for selectively preventing fluid flow between said first end and said second end of said cylinder.

3. A marine propulsion device in accordance with claim 2 wherein said manually operable valve means includes a manually operable single actuator and is operable in a first mode to prevent fluid flow from said second end of said cylinder to said first end of said cylinder and to permit fluid flow from said first cylinder end to said second cylinder end, and is operable in a second mode to prevent fluid flow from said first end of said cylinder to said second end of said cylinder and to permit fluid flow from said second cylinder end to said first cylinder end.

4. A marine propulsion device in accordance with claim 2 wherein said fluid chamber is in unrestricted communication with said first end of said cylinder.

5. A marine propulsion device in accordance with claim 3 wherein said valve means includes a first one-way check valve which is located in said conduit, which permits fluid flow from said first end of said cylinder to said second end of said cylinder, and which prohibits fluid flow from said second end of said cylinder to said first end of said cylinder, a second one-way check valve which is located in said conduit, which permits fluid flow from said second end of said cylinder to said first end of said cylinder, and which prohibits fluid flow from said first end of said cylinder to said second end of said cylinder, and means for alternately opening, for fluid flow in one direction through said valve means, one of said first one-way check valve and said second one-way check valve, and, for fluid flow in an opposite direction through said valve means, said other of said first one-way check valve and said second one-way check valve.

6. A marine propulsion device in accordance with claim 5, wherein said means for alternately opening one of said first one-way check valve and said second one-way check valve comprises a spool slidably received in said conduit and between said first one-way check valve and said second one-way check valve, said spool valve being mechanically connected to and slideably displaceable by said manually operable actuator between a first position adjacent said first one-way check valve and a second position adjacent said second one-way check valve, means permitting fluid flow relative to said spool in said conduit, and projection means on said spool for respectively opening said first one-way check valve when said spool is adjacent said first one-way check valve, and for opening said second one-way check valve when said spool is adjacent said second one-way check valve.

7. A marine propulsion device in accordance with claim 2 wherein said fluid chamber is in communication with said first end of said cylinder.

8. A marine propulsion device in accordance with claim 1 wherein said manually operable valve means includes a manually operable single actuator and is operable in a first mode to prevent fluid flow from said second end of said cylinder to said first end of said cylinder and to permit fluid flow from said first cylinder end to said second cylinder end, and is operable in a second mode to prevent fluid flow from said first end of said cylinder to said second end of said cylinder and to permit fluid flow from said second cylinder end to said first cylinder end.

9. A marine propulsion device in accordance with claim 8 wherein said valve means includes a first one-way check valve which is located in said conduit, which permits fluid flow from said first end of said cylinder to said second end of said cylinder, and which prohibits fluid flow from said second end of said cylinder to said first end of said cylinder, a second one-way check valve which is located in said conduit, which permits fluid flow from said second end of said cylinder to said first end of said cylinder, and which prohibits fluid flow from said first end of said cylinder to said second end of said cylinder, and means for alternately opening, for fluid flow in one direction through said valve means, one of said first one-way check valve and said second one-way check valve, and, for fluid flow in an opposite direction through said valve means, said other of said first one-way check valve and said second one-way check valve.

10. A marine propulsion device in accordance with claim 1 wherein said fluid chamber is in unrestricted communication with said first end of said cylinder.

11. A marine propulsion device comprising a support bracket adapted to be attached to a boat hull, a propulsion unit, means connecting said propulsion unit and said support bracket for tilting movement of said propulsion unit in a vertical plane about a horizontal transverse axis between an operating position and a raised nonoperating position, extendable and retractable cylinder-piston means for facilitating manual tilting movement of said propulsion unit upwardly about said axis when said support bracket is attached to a boat hull, said cylinder-piston means comprising a cylinder including a first end and a second end, a piston located in said cylinder for reciprocative movement therein, a piston rod connected to said piston and extending from said second end of said cylinder, means connecting said cylinder-piston means to said support bracket and said propulsion unit for extending said cylinder-piston means in response to upward tilting movement of said propulsion unit, and for retracting said cylinder-piston means in response to downward tilting movement of said propulsion unit, said connecting means comprising means pivotally connecting said first end of said cylinder to one of said support bracket and said propulsion unit, and means pivotally connecting said piston rod to the other of said support bracket and said propulsion unit, a predetermined quantity of incompressible fluid partially filling said cylinder, a gas with a pressure higher than atmospheric pressure filling the remainder of said cylinder, a conduit communicating soley with said first end and said second end of said cylinder, and manually operable valve means in said conduit for selectively preventing fluid flow between said first end and said second end of said cylinder, said manually operable valve means being operable in a first mode to prevent fluid flow from said second end of said cylinder to said first end of said cylinder and to permit fluid flow from said first cylinder end to said second cylinder end, and being operable in a second mode to prevent fluid flow from said first end of said cylinder to said second end of said cylinder and to permit fluid flow from said second cylinder end to said first cylinder end, said valve means including a manually operable single actuator, a first one-way check valve which is located in said conduit, which permits fluid flow from said first end of said cylinder to said second end of said cylinder, and which prohibits fluid flow from said second end of said cylinder to said first end of said cylinder, a second one-way check valve which is located in said conduit, which permits fluid flow from said second end of said cylinder to said first end of said cylinder, and which prohibits fluid flow from said first end of said cylinder to said second end of said cylinder, and means for alternately opening, for fluid flow in one direction through said valve means, one of said first one-way check valve and said second one-way check valve, and, for fluid flow in an opposite direction through said valve means, the other of said first one-way check valve and said second one-way check valve, said means for alternately opening one of said first one-way check valve and said second one-way check valve comprising a spool slidably received in said conduit and between said first one-way check valve and said second one-way check valve, said spool valve being mechanically connected to and slideably displaceable by said manually operable acutator between a first position adjacent said first one-way check valve and a second position adjacent said second one-way check valve, means permitting fluid flow relative to said spool in said conduit between said first one-way check valve and said second one-way check valve, and projection means on said spool for opening said first one-way check valve when said spool is adjacent said first one-way check valve, and for opening said second one-way check valve when said spool is adjacent said second one-way check valve.

12. A marine propulsion device comprising a support bracket adapted to be attached to a boat hull, a propulsion unit, means connecting said propulsion unit and said support bracket for tilting movement of said propulsion unit in a vertical plane about a horizontal transverse axis between an operating position and a raised nonoperating position, extendable and retractable cylinder-piston means for facilitating manual tilting movement of said propulsion unit upwardly about said axis when said support bracket is attached to a boat hull, said cylinder-piston means comprising a cylinder including a first end and a second end, a piston located in said cylinder for reciprocative movement therein, a piston rod connected to said piston and extending from said second end of said cylinder, means connecting said cylinder-piston means to said support bracket and said propulsion unit for extending said cylinder-piston means in response to upward tilting movement of said propulsion unit, and for retracting said cylinder-piston means in response to downward tilting movement of said propulsion unit, said connecting means comprising means pivotally connecting said first end of said cylinder to one of said support bracket and said propulsion unit, and means pivotally connecting said piston rod to the other of said support bracket and said propulsion unit, a housing, a movable wall located in said housing and defining a variable volume gas chamber and a variable volume fluid chamber communicating with said cylinder, a predetermined quantity of incompressible fluid filling said cylinder and said fluid chamber, a gas with a pressure higher than atmospheric pressure filling said gas chamber, a conduit communicating solely with said first and second ends of said cylinder, and manually operable valve means in said conduit for selectively preventing fluid flow between said first end and said second end of said cylinder, said valve means being operable in a first mode to prevent fluid flow from said second end of said cylinder to said first end of said cylinder and to permit fluid flow from said first cylinder end to said second cylinder end, and being operable in a second mode to prevent fluid flow from said first end of said cylinder to said second end of said cylinder and to permit fluid flow from said second cylinder end to said first cylinder end, said valve means including a manually operable single actuator, a first one-way check valve which is located in said conduit, which permits fluid flow from said first end of said cylinder to said second end of said cylinder, and which prohibits fluid flow from said second end of said cylinder to said first end of said cylinder, a second one-way check valve which is located in said conduit, which permits fluid flow from said second end of said cylinder to said first end of said cylinder, and which prohibits fluid flow from said first end of said cylinder to said second end of said cylinder, and means for alternately opening, for fluid flow in one direction through said valve means, one of said first one-way check valve and said second one-way check valve, and, for fluid flow in an opposite direction through said valve means, the other of said first one-way check valve and said second one-way check valve, said means for alternately opening one of said first one-way check valve and said second one-way check valve comprising a spool slidably received in said conduit and located between said first one-way check valve and said second one-way check valve, said spool valve being mechanically connected to and slidably displaceable by said manually operable actuator between a first position adjacent said first one-way check valve and a second position adjacent said second one-way check valve, means permitting fluid flow relative to said spool in said conduit, and projection means on said spool for opening said first one-way check valve when said spool is adjacent said first one-way check valve, and for opening said second one-way check valve when said spool is adjacent said second one-way check valve.

13. A marine propulsion device in accordance with claim 2 wherein said manually operable valve means includes a manually operable single actuator and is operable in a first mode to prevent fluid flow from said second end of said cylinder to said first end of said cylinder and to permit fluid flow from said first cylinder end to said second cylinder end, and is operable in a second mode to prevent fluid flow from said first end of said cylinder to said second end of said cylinder and to permit fluid flow from said second cylinder end to said first cylinder end.

14. A marine propulsion device in accordance with claim 13 wherein said valve means includes a first one-way check valve which is located in said conduit, which permits fluid flow from said first end of said cylinder to said second end of said cylinder, and which prohibits fluid flow from said second end of said cylinder to said first end of said cylinder, a second one-way check valve which is located in said conduit, which permits fluid flow from said second end of said cylinder to said first end of said cylinder, and which prohibits fluid flow from said first end of said cylinder to said second end of said cylinder, and means for alternately opening, for fluid flow in one direction through said valve means, one of said first one-way check valve and said second one-way check valve, and, for fluid flow in an opposite direction through said valve means, said other of said first one-way check valve and said second one-way check valve.

* * * * *

Notice of Adverse Decision in Interference

In Interference No. 102,166, involving Patent No. 4,605,377, T. D. Wenstadt, MANUAL LIFT MEANS FOR MARINE PROPULSION DEVICE, final judgment adverse to the patentee was rendered Jan. 17, 1990, as to claims 1, 2, 4, 7 and 10.

( *Official Gazette May 8, 1990* )